US010556139B2

(12) United States Patent
Quan

(10) Patent No.: US 10,556,139 B2
(45) Date of Patent: Feb. 11, 2020

(54) NETWORK-TYPE TEMPERATURE-CONTROLLED HANGING EXTINGUISHING SYSTEM

(71) Applicant: China Aerospace Construction Group Co., Ltd., Beijing (CN)

(72) Inventor: Longhao Quan, Beijing (CN)

(73) Assignee: China Aerospace Construction Group Co., Ltd., Beijing (CN)

( * ) Notice: Subject to any disclaimer, the term of this patent is extended or adjusted under 35 U.S.C. 154(b) by 188 days.

(21) Appl. No.: 15/833,491

(22) Filed: Dec. 6, 2017

(65) Prior Publication Data

US 2018/0093116 A1 Apr. 5, 2018

(30) Foreign Application Priority Data

Dec. 6, 2016 (CN) ..... 2016 1 1110204

(51) Int. Cl.

| | |
|---|---|
| ***A62C 37/48*** | (2006.01) |
| ***A62C 37/42*** | (2006.01) |
| ***A62C 35/60*** | (2006.01) |
| ***A62C 37/38*** | (2006.01) |

(52) U.S. Cl.

CPC ..... *A62C 37/48* (2013.01); *A62C 35/60* (2013.01); *A62C 37/38* (2013.01); *A62C 37/42* (2013.01)

(58) Field of Classification Search

CPC ..... A62C 35/58; A62C 35/60; A62C 35/62; A62C 35/64; A62C 35/645; A62C 37/48; A62C 37/38; A62C 37/42; A62C 37/11; A62C 37/12; A62C 37/14

See application file for complete search history.

(56) References Cited

U.S. PATENT DOCUMENTS

2011/0231024 A1* 9/2011 Medizade ..... F04B 49/065 700/282
2013/0200282 A1* 8/2013 Quan ..... F16K 31/08 251/65

(Continued)

FOREIGN PATENT DOCUMENTS

| | | |
|---|---|---|
| CN | 101632854 B | 2/2012 |
| CN | 203770816 U | 8/2014 |
| CN | 204972814 U | 1/2016 |

*Primary Examiner* — Jason J Boeckmann

(57) ABSTRACT

A network-type temperature-controlled hanging extinguishing system includes: a main fire-fighting pipe which has at least one fire-extinguishing medium support port; at least one fire-extinguishing medium pressure bearing tank communicated with the main fire-fighting pipe; at least one fire sprinkler valve which is communicated with the main fire-fighting pipe and includes a memory alloy part adapted for controlling opening and closing a valve body; and at least open nozzle which is communicated with the fire sprinkler valve, such that when the fire sprinkler valve is opened, the fire-extinguishing medium is sprayed, and when the fire sprinkler valve is closed, the fire-extinguishing medium is stopped spraying. An amount of the fire-extinguishing medium pressure bearing tanks is different from that of the open nozzles; a user is able to select an appropriate amount of fire-extinguishing medium pressure bearing tanks as required to reduce the manufacturing, assembly and maintenance cost of the entire system.

16 Claims, 3 Drawing Sheets

(56) References Cited

U.S. PATENT DOCUMENTS

2013/0312842 A1* 11/2013 Quan ..... A62C 37/08
137/78.1
2014/0338927 A1* 11/2014 Palle ..... A62C 99/0072
169/16

* cited by examiner

NETWORK-TYPE TEMPERATURE-CONTROLLED HANGING EXTINGUISHING SYSTEM

CROSS REFERENCE OF RELATED APPLICATION

The present invention claims priority under 35 U.S.C. 119(a-d) to CN 201611110204.6, filed Dec. 6, 2016.

BACKGROUND OF THE PRESENT INVENTION

Field of Invention

The present invention relates to the technical field of fire-fighting equipment, and more particularly to a network-type temperature-controlled hanging extinguishing system.

Description of Related Arts

The hanging extinguishing system includes the hanging extinguisher. It is a branch of the fire-fighting system, is mainly adapted for the relatively small enclosed space to eliminate fire. Generally, the hanging extinguisher automatically sprays for extinguishing, so that it must have an automatic starting function.

In the related arts, the hanging extinguisher usually has the temperature-sensitive glass bulb at the nozzle part thereof; under normal circumstances, the upper end of the glass bulb stands up against the nozzle, when the fire occurs, the temperature rises, the liquid inside the temperature-sensitive glass bulb makes the temperature-sensitive glass bulb broken, the dry powder fire extinguishing agent is sprayed to eliminate fire. The above fire-fighting method, a temperature-sensitive glass bulb can only control the opening and closing of one pressure bearing tank. In other words, in the related arts, the hanging extinguishing system can include multiple hanging extinguishers, every extinguisher comprises a glass bulb and a corresponding pressure bearing tank. This kind of hanging extinguishing system has some drawbacks as follows.

Firstly, the opening and closing of the pressure bearing tank under the control of the temperature-sensitive glass bulb is irreversible; once being opened, the pressure bearing tank is unable to be automatically closed till the fire extinguishing medium in the pressure bearing tank is exhausted, which easily leads to waste. Secondly, due to one temperature-sensitive glass bulb is corresponding to one pressure bearing tank, one set of hanging extinguishing system must have enough pressure bearing tanks, so that the hanging extinguishing system is higher in cost and is inconvenient for installation and maintenance.

SUMMARY OF THE PRESENT INVENTION

The present invention aims at resolving at least one of the above technical problems in prior arts to a certain extent. Accordingly, the present invention needs to provide a network-type temperature-controlled hanging extinguishing system with simple structure and low cost.

The network-type temperature-controlled hanging extinguishing system, provided by the present invention, comprises: a main fire-fighting pipe which has at least one fire-extinguishing medium support port; at least one fire-extinguishing medium pressure bearing tank communicated with the main fire-fighting pipe; at least one fire sprinkler valve which is communicated with the main fire-fighting pipe and comprises a memory alloy part adapted for controlling opening and closing a valve body; and at least open nozzle which is communicated with the fire sprinkler valve, such that when the fire sprinkler valve is opened, a fire-extinguishing medium is sprayed, and when the fire sprinkler valve is closed, the fire-extinguishing medium is stopped spraying.

In the network-type temperature-controlled hanging extinguishing system provided by the present invention, an amount of the fire-extinguishing medium pressure bearing tanks is different from that of the open nozzles; a user is able to select an appropriate amount of fire-extinguishing medium pressure bearing tanks as required; the appropriate amount of fire-extinguishing medium pressure bearing tanks is decreased to reduce the manufacturing cost of the entire network-type temperature-controlled hanging extinguishing system, and simultaneously reduce the assembly and maintenance cost thereof.

Furthermore, the network-type temperature-controlled hanging extinguishing system provided by the present invention may also have following additional technical features.

Preferably, every fire sprinkler valve is connected with multiple open nozzles.

Preferably, a check valve is located at the fire-extinguishing medium support port.

Preferably, a touch switch is located at an inlet of the check valve, the touch switch is connected with a GPS (Global Position System) positioner, so as to activate the GPS positioner when the check valve operates.

Preferably, the fire sprinkler valve comprises a valve body and a self-reliant control mechanism connected with the valve body; the self-reliant control mechanism comprises a base connected with the valve body, a rubber piston gasket located between the base and the valve body, a valve spool passing through the base, a seal tube, a magnetic ring sleeve, a connecting rod, a valve cap, a memory alloy part, a baffle and a fixing rod; the rubber piston gasket has a piston pressure inputting hole and a piston pressure relief hole which is communicated with a pressure relief hole of the valve body; a magnetic column component is sealedly installed at an upper portion of the valve spool, a small piston is installed at a lower portion thereof, and the upper portion of the valve spool is inserted into the seal tube; the magnetic ring sleeve is sleeved onto the seal tube; a magnetic ring component is located within the magnetic ring sleeve, an upper portion of the magnetic ring sleeve is connected with the connecting rod, and the connecting rod passes through the valve cap, the memory alloy part and the baffle and then is connected with the fixing rod; the self-reliant control mechanism further comprises a detachable valve cover which is adapted for fixing magnetic ring and is in threaded connection with the valve cap and the base; the seal tube has a flanging formed at an opening end thereof; the flanging is locked between the detachable valve cover and the base.

Preferably, a seal gasket is located between the base and the seal tube.

Preferably, the seal tube is made of copper.

Preferably, a reset spring, which is against the valve cap, is sleeved onto the magnetic ring sleeve.

Preferably, a cross section of the upper portion of the magnetic ring sleeve is a polygon, and the valve cap has a trough therein which matches with the upper portion of the magnetic ring sleeve.

Preferably, a cross-sectional area ratio of the piston pressure relief hole to a water inlet of the valve body is larger than 1:80.

Additional aspects and advantages of the present invention will be partially set forth in the following description, and will be apparent by the following description, or may be learned by the practice of the present invention.

DETAILED DESCRIPTION OF THE PREFERRED EMBODIMENT

Figure 1:
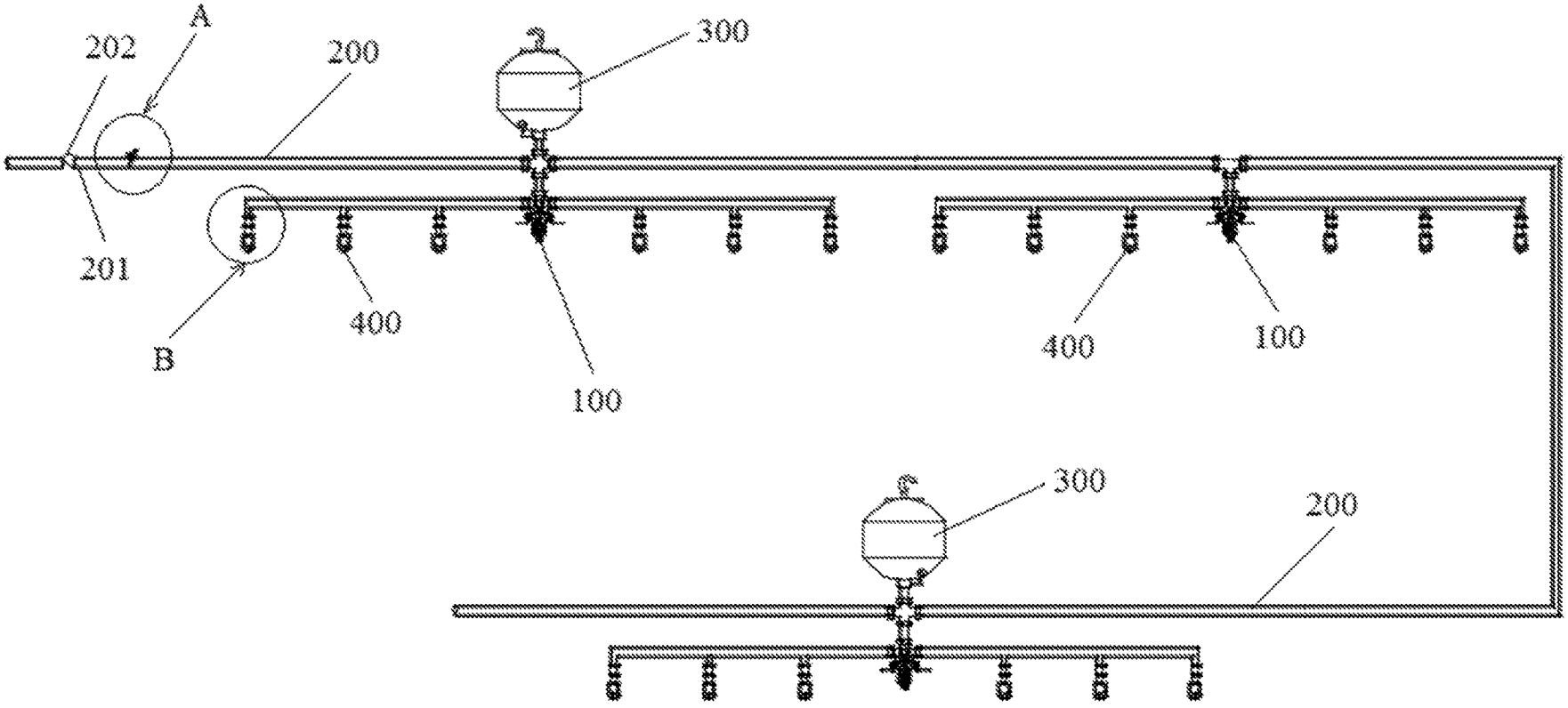
FIG. 1 is a perspective view of a network-type temperature-controlled hanging extinguishing system according to a preferred embodiment of the present invention.

The embodiment of the present invention is described in detail below, examples of which are shown in the accompanying drawings, wherein: like or similar reference numerals refer to like or similar elements or elements having the same or similar functions. The embodiments described below with reference to the accompanying drawings are exemplary and are intended to be illustrative of the present invention and are not to be construed as limiting the present invention.

In the description of the present invention, it is noted that the orientation or position relationship described by terms such as "center", "longitudinal", "transverse", "length", "width", "thickness", "above", "below", "front", "back", "left", "right", "vertical", "horizontal", "top", "bottom", "internal", "external", "clockwise" and "anticlockwise" is based on the accompanying drawings, which is only for simplifying the description of the present invention, not for indicating or implying a specific orientation, and a structure and an operation at the specific orientation of the devices or parts. Thus, the above words are not the limitations of the present invention.

Moreover, terms such as "first" and "second" are only for description, not for indicating or implying a relative importance or implicitly indicating the amount of indicated technical features. Therefore, the amount of the technical features named as "first" and "second" can be two or more unless specifically regulated and limited.

In the description of the present invention, unless specifically regulated and limited, terms such as "mount", "link", "connect" and "fix" should be comprehended in the broad sense. For example, the parts can be fixedly connected, detachably connected or integrally connected; the parts can be mechanically connected or electrically connected; the part can be directly connected or indirectly connected through a medium; and two parts can be internally communicated or interacted with each other. For one skilled in the art, it is easy to understand the specific meaning of the above words in the present invention.

In the description of the present invention, unless specifically regulated and limited, the first feature is above or below the second feature, which means that the first feature can directly contact with the second feature, or the first feature can indirectly contact with the second feature through other features therebetween. Moreover, the first feature is above the second feature, which means that the first feature is higher than the second feature on horizontal height; similarly, the first feature is below the second feature, which means that the first feature is lower than the second feature on horizontal height.

Referring to FIG. 1 of the drawings, a network-type temperature-controlled hanging extinguishing system according to a preferred embodiment of the present invention is illustrated, comprising a main fire-fighting pipe 200, at least one fire-extinguishing medium pressure bearing tank 300, at least one fire sprinkler valve 100 and at least one open nozzle 400.

Specifically, the main fire-fighting pipe 200 has at least one fire-extinguishing medium support port 201 through which a fire-extinguishing medium is injected into the main fire-fighting pipe 200, the fire-extinguishing medium can be water, hexafluoropropane and dry powder.

Every fire-extinguishing medium pressure bearing tank 300 is communicated with the main fire-fighting pipe 200 for storing the fire-extinguishing medium and providing the main fire-fighting pipe 200 with the stored fire-extinguishing medium.

The fire sprinkler valve 100, which is communicated with the main fire-fighting pipe 200, comprises a memory alloy part 22 adapted for controlling opening and closing a valve body 1; the valve body 1 is communicated with at least one open nozzle 400.

The open nozzle 400 is communicated with the fire sprinkler valve 100, such that when the fire sprinkler valve 100 is opened, the fire-extinguishing medium is sprayed, and when the fire sprinkler valve 100 is closed, the fire-extinguishing medium is stopped spraying, thus controlling the extinguishing system to eliminate fire through the fire sprinkler valve 100.

Preferably, in the network-type temperature-controlled hanging extinguishing system provided by the present invention, an amount of the fire-extinguishing medium pressure bearing tanks 300 is different from that of the open nozzles 400; a user is able to select an appropriate amount of fire-extinguishing medium pressure bearing tanks 300 as required; the appropriate amount of fire-extinguishing medium pressure bearing tanks 300 is decreased to reduce the manufacturing cost of the entire network-type temperature-controlled hanging extinguishing system, and simultaneously reduce the assembly and maintenance cost thereof.

As shown in FIG. 1, the network-type temperature-controlled hanging extinguishing system according to the preferred embodiment of the present invention is illustrated, wherein: every fire sprinkler valve 100 is connected with multiple open nozzles 400, such that the multiple open nozzles 400 are controlled through one fire sprinkler valve 100 to spray the fire-extinguishing medium, so as to improve the fire-extinguishing efficiency and reduce the fire-extinguishing cost.

As shown in FIG. 1, the network-type temperature-controlled hanging extinguishing system according to the preferred embodiment of the present invention is illustrate, wherein: a check valve 202 is located at the fire-extinguishing medium support port 201, such that the fire-extinguishing medium is allowed to enter the main fire-fighting pipe 200 for avoiding unnecessary reflow.

Referring to FIG. 1, in order to know the location of the fire in real time, the network-type temperature-controlled hanging extinguishing system according to the preferred embodiment of the present invention is illustrated, wherein:

a touch switch 600 is located at an inlet of the check valve 202, the touch switch is connected with a GPS (Global Position System) positioner 500, so as to activate the GPS positioner when the check valve 202 operates, thus the GPS positioner transfers positional information to outside.

Figure 2:
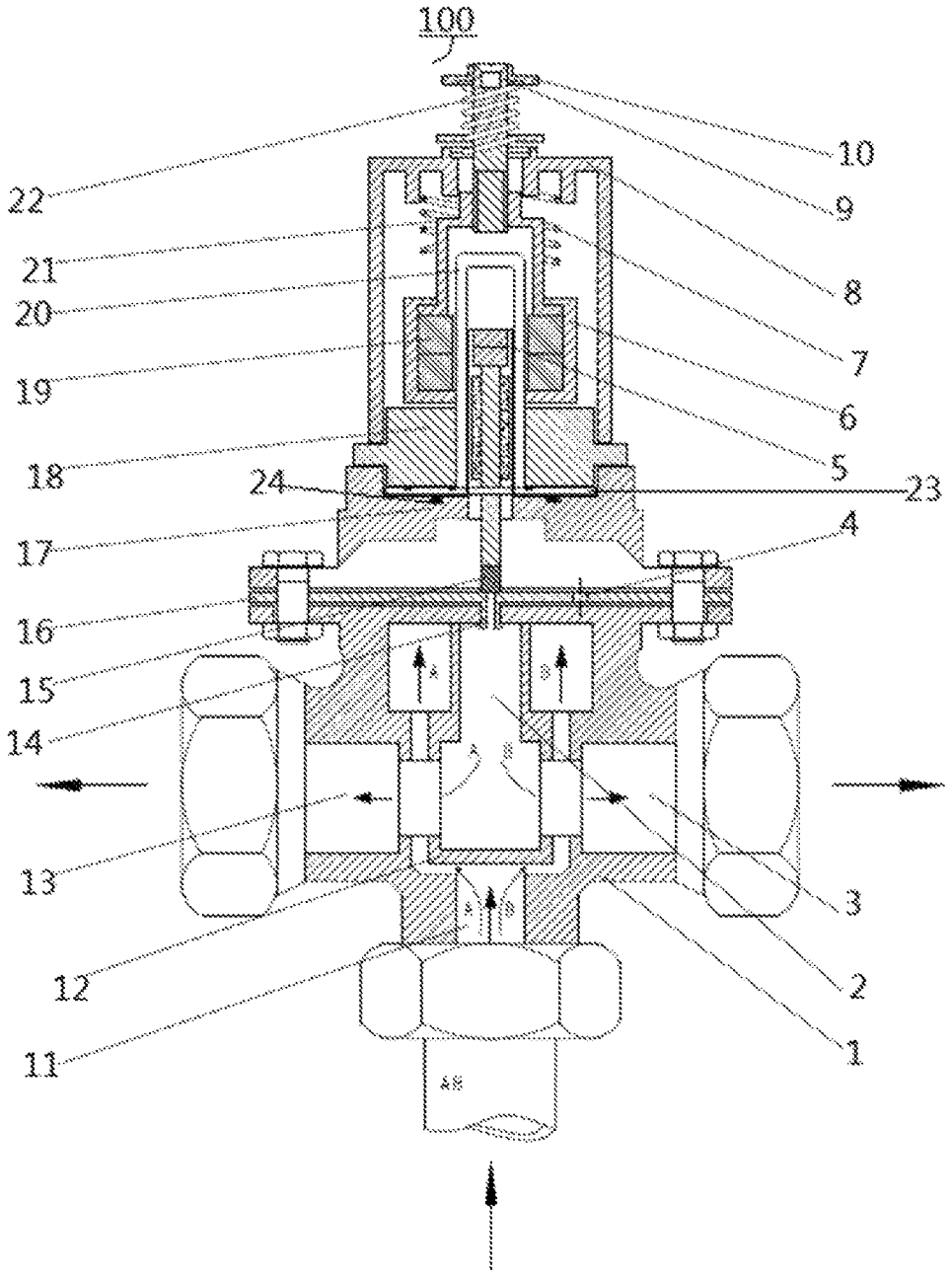
FIG. 2 is a perspective view of a fire sprinkler valve of the network-type temperature-controlled hanging extinguishing system according to the above preferred embodiment of the present invention.
Figure 3:
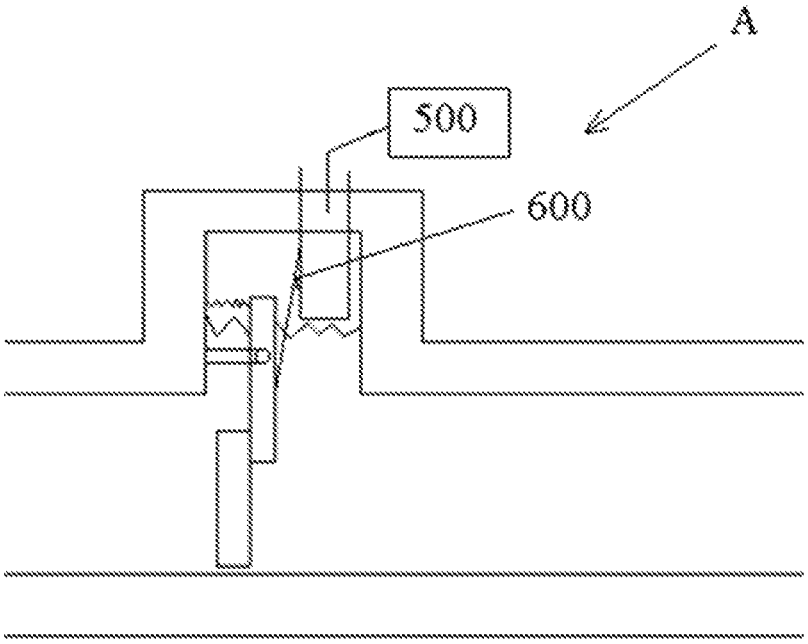
FIG. 3 is a partially enlarged view of a substructure circled and labeled as A in FIG. 1.
Figure 4:
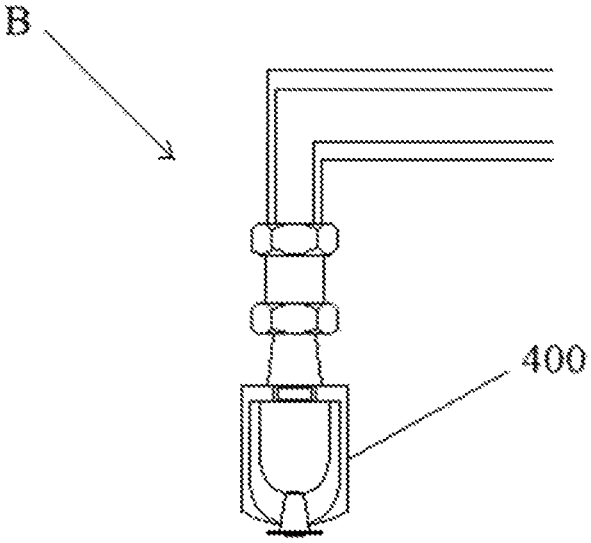
FIG. 4 is a partially enlarged view of a substructure circled and labeled as B in FIG. 1.

Referring to FIG. 2, the fire sprinkler valve 100 of the network-type temperature-controlled hanging extinguishing system according to the preferred embodiment of the present invention is illustrated, which comprises a valve body 1 and a self-reliant control mechanism connected with the valve body 1.

Specifically, the self-reliant control mechanism comprises a base 17 connected with the valve body 1, a rubber piston gasket 16 located between the base 17 and the valve body 1, a valve spool 5 passing through the base 17, a seal tube 20, a magnetic ring sleeve 6, a connecting rod 21, a valve cap 8, a memory alloy part 22, a baffle 10 and a fixing rod 9.

The rubber piston gasket 16 has a piston pressure inputting hole 4 and a piston pressure relief hole 14 which is communicated with a pressure relief hole of the valve body 1; a magnetic column component is sealedly installed at an upper portion of the valve spool 5, a small piston 15 is installed at a lower portion thereof, and the upper portion of the valve spool 5 is inserted into the seal tube 20; the magnetic ring sleeve 6 is sleeved onto the seal tube 20.

A magnetic ring component 19 is located within the magnetic ring sleeve 6, an upper portion of the magnetic ring sleeve 6 is connected with the connecting rod 21, and the connecting rod 21 passes through the valve cap 8, the memory alloy part 22 and the baffle 10 and then is connected with the fixing rod 9.

The self-reliant control mechanism further comprises a detachable valve cover 18 which is adapted for fixing magnetic ring and is in threaded connection with the valve cap 8 and the base 17; the seal tube 20 has a flanging 23 formed at an opening end thereof; the flanging 23 is locked between the detachable valve cover 18 and the base 17; that is, an upper portion of the detachable valve cover 18 is in threaded connection with the valve cap 8, a lower portion of the detachable valve cover 18 is in threaded connection with the base 17, and the flanging 23 of the seal tube is positioned between the detachable valve cover 18 and the base 17.

The seal tube 20 is fixed with the base 17 through the detachable valve cover 18 without welding, so that the self-reliant fire sprinkler valve 100 having the detachable valve cover is convenient for being operated and installed. Furthermore, through the detachable valve cover 18, the seal tube 20 is positioned. In the initial installation, whether other parts of the self-reliant control mechanism are installed is able to be selected as required, which is more convenient for operation and construction.

Referring to FIG. 2, in order to improve the sealing effect, according to the preferred embodiment of the present invention, a seal gasket 24 is located between the base 17 and the seal tube 20.

Furthermore, according to the preferred embodiment of the present invention, the seal tube 20 is made of copper. It should be understood that according to the preferred embodiment of the present invention, a reset spring 7, which is against the valve cap 8, is sleeved onto the magnetic ring sleeve 6. To facilitate the implementation, a cross section of the upper portion of the magnetic ring sleeve 6 is a polygon, and the valve cap 8 has a trough therein which matches with the upper portion of the magnetic ring sleeve 6.

According to the preferred embodiment of the present invention, in order to improve the heat accumulating efficiency, the self-reliant fire sprinkler valve 100 having the detachable valve cover further comprises a heat accumulating cover (not shown in the drawings) which is connected with an upper portion of the valve cap 8. According to the preferred embodiment of the present invention, a cross-sectional area ratio of the piston pressure relief hole 14 to a water inlet of the valve body is larger than 1:80.

Referring to FIG. 2, according to the preferred embodiment of the present invention, the valve body 1 has a water inlet 11 and two water outlets 3 and 13. It should be understood that a water segregator 12 is located within the valve body 1, and the water inlet 11 is communicated with a segregator water inlet 2 of the water segregator 12 for achieving one entrance and multiple exits.

As shown in FIG. 2, the working principle of the fire sprinkler valve 100 according to the preferred embodiment of the present invention is as follows. The fire sprinkler valve 100 is installed within the floor ceiling, the baffle 10, the fixing rod 11, the memory alloy part 22, the heat accumulating cover and the spray header are installed below the floor ceiling and exposed to the room. The water inlet 11 of the valve body in the floor ceiling is communicated with the main fire-fighting pipe 200 through pipelines, the water outlets 3 and 13 of the valve body are communicated with the open nozzle 400 below the floor ceiling through pipelines.

An exposed part of the fire sprinkler valve 100 after being installed is similar to existing glass bubble fire-fighting device in shape.

When the room temperature does not increase abnormally, that is, no fire occurs, the memory alloy part 22 is in a contracted state; under the action of the resilience force of the reset spring 7, the magnetic ring sleeve 6 is forced to move towards a lower end of the valve spool 5, the magnetic column component within the valve spool 5 is driven to move downwardly due to magnetic coupling interaction, so as to force the small piston 15 at the lower end of the valve spool 5 to block the piston pressure relief hole 14 of the rubber piston gasket 16.

When the indoor fire causes the indoor temperature rises abnormally, under the heat reflection action of the heat accumulating cover, the ambient temperature of the memory alloy part 22 quickly increases, when the ambient temperature reaches the deformation temperature value of the memory alloy part, the spring-like memory alloy part expands so as to drive the baffle 10 to move upwardly, and then the connecting rod 21 is driven to move upwardly through the baffle 10, and then the magnetic ring sleeve 6 is driven to move upwardly through the connecting rod 21; the magnetic ring component in the magnetic ring sleeve 6 drives the magnetic column component in the valve spool 5 to move upwardly under the action of magnetic coupling, and forces the small piston 15 to leave the piston pressure relief hole 14 on the rubber piston gasket 16, the water pressure at the upper end surface of the rubber piston gasket 16 is relieved through the piston pressure relief hole 14 and the two water outlets 3 and 13. The water pressure of the water inlet 11 applies a force to the rubber piston gasket 16 to remove the rubber piston gasket 16, the water flow directly flows into the water outlets 3 and 13, and is ejected via the open nozzle 400 through pipelines.

After the fire is extinguished, the indoor environment temperature gradually drops to a shrinkage value of the memory alloy part 22, the spring-shaped memory alloy part quickly shrinks to the original memory state; under the action of the reset spring, the magnetic ring sleeve rapidly moves downwardly, the small piston 15 blocks the piston pressure relief hole 14, to force the pressure on the upper end face of the rubber piston gasket 16 to be quickly established, the rubber piston gasket 16 quickly blocks the water inlet 11, the valve is closed and the spray is stopped.

Since the present invention has the function of automatic opening and closing, it is possible to avoid the defects of water spray when the existing glass bubbles are broken and the fire is extinguished, which not only saves water resources, but also avoids the second disaster caused by a large amount of water spray, thus achieving replacing the obvious lagging foreign glass bubble fire-fighting technologies with the domestic fire-fighting technology. The present invention also has a manual starting function, for example, when the valve is closed, it is only necessary to rotate right the connecting rod with the tool.

In the description of the present specification, the description of the terms "one embodiment", "some embodiments", "examples", "specific examples", or "some examples" and the like refer to the specific features described in connection with the embodiments or examples, structures, materials, or features are included in at least one embodiment or example of the present invention. In the present specification, the illustrative expressions of the above-mentioned terms need not be directed to the same embodiments or examples. Moreover, the specific features, structures, materials, or characteristic described above may be combined in any suitable embodiment or example in any suitable manner. In addition, various embodiments or examples described in this specification may be combined by those skilled in the art.

While the embodiments of the present invention have been shown and described above, it is understood that the above-described embodiments are exemplary and are not to be construed as limiting the invention, and changes, modifications, substitutions, and variations of the above-described embodiments may be made by those skilled in the art within the scope of the present invention.

What is claimed is:

1. A network-type temperature-controlled hanging extinguishing system, comprising:

a main fire-fighting pipe which has at least one fire-extinguishing medium support port;

at least one fire-extinguishing medium pressure bearing tank communicated with the main fire-fighting pipe;

at least one fire sprinkler valve which is communicated with the main fire-fighting pipe and comprises a memory alloy part adapted for controlling opening and closing a valve body; and at least open nozzle which is communicated with the fire sprinkler valve, such that when the fire sprinkler valve is opened, a fire-extinguishing medium is sprayed, and when the fire sprinkler valve is closed, the fire-extinguishing medium is stopped spraying, wherein:

the fire sprinkler valve comprises a valve body and a self-reliant control mechanism connected with the valve body; the self-reliant control mechanism comprises a base connected with the valve body, a rubber piston gasket located between the base and the valve body, a valve spool passing through the base, a seal tube, a magnetic ring sleeve, a connecting rod, a valve cap, a memory alloy part, a baffle and a fixing rod; the rubber piston gasket has a piston pressure inputting hole and a piston pressure relief hole which is communicated with a pressure relief hole of the valve body; a magnetic column component is sealedly installed at an upper portion of the valve spool, a small piston is installed at a lower portion thereof, and the upper portion of the valve spool is inserted into the seal tube; the magnetic ring sleeve is sleeved onto the seal tube; a magnetic ring component is located within the magnetic ring sleeve, an upper portion of the magnetic ring sleeve is connected with the connecting rod, and the connecting rod passes through the valve cap, the memory alloy part and the baffle and then is connected with the fixing rod; the self-reliant control mechanism further comprises a detachable valve cover which is adapted for fixing magnetic ring and is in threaded connection with the valve cap and the base; the seal tube has a flanging formed at an opening end thereof; the flanging is locked between the detachable valve cover and the base.

2. The network-type temperature-controlled hanging extinguishing system, as recited in claim 1, wherein: every fire sprinkler valve is connected with multiple open nozzles.

3. The network-type temperature-controlled hanging extinguishing system, as recited in claim 1, wherein: a check valve is located at the fire-extinguishing medium support port.

4. The network-type temperature-controlled hanging extinguishing system, as recited in claim 3, wherein: a touch switch is located at an inlet of the check valve, the touch switch is connected with a GPS (Global Position System) positioner, so as to activate the GPS positioner when the check valve operates.

5. The network-type temperature-controlled hanging extinguishing system, as recited in claim 3, wherein: a seal gasket is located between the base and the seal tube.

6. The network-type temperature-controlled hanging extinguishing system, as recited in claim 4, wherein: a seal gasket is located between the base and the seal tube.

7. The network-type temperature-controlled hanging extinguishing system, as recited in claim 5, wherein: the seal tube is made of copper.

8. The network-type temperature-controlled hanging extinguishing system, as recited in claim 6, wherein: the seal tube is made of copper.

9. The network-type temperature-controlled hanging extinguishing system, as recited in claim 7, wherein: a reset spring, which is against the valve cap, is sleeved onto the magnetic ring sleeve.

10. The network-type temperature-controlled hanging extinguishing system, as recited in claim 8, wherein: a reset spring, which is against the valve cap, is sleeved onto the magnetic ring sleeve.

11. The network-type temperature-controlled hanging extinguishing system, as recited in claim 1, wherein: a cross section of the upper portion of the magnetic ring sleeve is a polygon, and the valve cap has a trough therein which matches with the upper portion of the magnetic ring sleeve.

12. The network-type temperature-controlled hanging extinguishing system, as recited in claim 2, wherein: a cross section of the upper portion of the magnetic ring sleeve is a polygon, and the valve cap has a trough therein which matches with the upper portion of the magnetic ring sleeve.

13. The network-type temperature-controlled hanging extinguishing system, as recited in claim 10, wherein: a cross section of the upper portion of the magnetic ring sleeve is a polygon, and the valve cap has a trough therein which matches with the upper portion of the magnetic ring sleeve.

14. The network-type temperature-controlled hanging extinguishing system, as recited in claim 1, wherein: a cross-sectional area ratio of the piston pressure relief hole to a water inlet of the valve body is larger than 1:80.

15. The network-type temperature-controlled hanging extinguishing system, as recited in claim 2, wherein: a cross-sectional area ratio of the piston pressure relief hole to a water inlet of the valve body is larger than 1:80.

16. The network-type temperature-controlled hanging extinguishing system, as recited in claim 13, wherein: a cross-sectional area ratio of the piston pressure relief hole to a water inlet of the valve body is larger than 1:80.

* * * * *